US008191289B2

(12) United States Patent
Raftery

(10) Patent No.: US 8,191,289 B2
(45) Date of Patent: Jun. 5, 2012

(54) SKID FOR A SNOW BLOWER AND A SNOW BLOWER INCORPORATING THE SAME

(75) Inventor: William Barret Raftery, Canton, OH (US)

(73) Assignee: Raftery Design, Inc., Canton, OH (US)

( * ) Notice: Subject to any disclaimer, the term of this patent is extended or adjusted under 35 U.S.C. 154(b) by 0 days.

(21) Appl. No.: 13/086,576

(22) Filed: Apr. 14, 2011

(65) Prior Publication Data

US 2011/0314707 A1 Dec. 29, 2011

Related U.S. Application Data

(60) Provisional application No. 61/359,066, filed on Jun. 28, 2010.

(51) Int. Cl.
*E01H 5/06* (2006.01)

(52) U.S. Cl. ..... 37/271; 16/18 CG; 16/18 B; 16/29

(58) Field of Classification Search ..... 37/252, 37/270, 407; 172/376, 377; 280/5.2, 5.24; 492/60, 48; 16/18 CG, 18 B, 18 R, 19, 29, 16/31 R, 32, 33, 40, 41, 42 R, 45, 95, 95 R, 16/107; 301/5.305, 37.101
See application file for complete search history.

(56) References Cited

U.S. PATENT DOCUMENTS 2,186,724 A * 1/1940 Harris ..... 16/40
2,525,971 A * 10/1950 Stone ..... 384/59
2,768,453 A * 10/1956 Adams, Jr. ..... 37/252
3,078,603 A * 2/1963 Ertsgaard et al. ..... 37/252
D199,033 S * 9/1964 Brennan ..... D15/12
3,239,954 A * 3/1966 Brier ..... 37/251
3,267,594 A * 8/1966 Mattson et al. ..... 37/246
3,468,041 A * 9/1969 Mattson et al. ..... 37/246
3,557,401 A * 1/1971 Jenkins ..... 16/26
3,742,626 A * 7/1973 Ellis ..... 37/260
3,744,083 A * 7/1973 Jenkins ..... 16/26
3,774,321 A * 11/1973 David ..... 37/243
3,858,271 A * 1/1975 Howard et al. ..... 16/45
4,023,287 A * 5/1977 de Brito ..... 37/231
4,255,879 A * 3/1981 Greider ..... 37/245
5,438,770 A * 8/1995 Miller ..... 37/227
5,911,422 A * 6/1999 Carpenter et al. ..... 280/8
5,960,615 A * 10/1999 Meetze ..... 56/16.7
6,508,018 B1 * 1/2003 O'Brien ..... 37/223
6,899,345 B1 * 5/2005 Bearden ..... 280/43
7,540,102 B2 6/2009 Olmr et al.
2005/0066553 A1 * 3/2005 Light ..... 37/242
2008/0210445 A1 * 9/2008 Paulson ..... 172/1
* cited by examiner

*Primary Examiner* — Jamie L McGowan
(74) *Attorney, Agent, or Firm* — Sand & Sebolt

(57) ABSTRACT

A skid for use on a snow blower, where the snow blower includes an auger housing through which snow removed from an area is channeled. The skid includes a body that is secured to a vertical side wall of the auger housing. The body includes a sliding surface which assists the auger housing in sliding over snow-covered regions of the area being cleared; and a rolling surface which assists the auger housing to travel over snow-free regions of the area. A slot is provided in the sliding surface of the skid and a portion of the rolling surface projects for a distance below the sliding surface. An adapter plate may be positioned between the body and the side wall of the auger housing. The adapter plate enables the body to be secured to different makes of auger housing.

22 Claims, 13 Drawing Sheets

SKID FOR A SNOW BLOWER AND A SNOW BLOWER INCORPORATING THE SAME

CROSS-REFERENCE TO RELATED APPLICATION

This invention claims the benefit of U.S. Provisional Patent Application No. 61/359,066, filed Jun. 28, 2010, the entire specification of which is incorporated herein by reference.

BACKGROUND OF THE INVENTION

1. Technical Field

This application relates generally to snow removal devices. More particularly, the invention relates to snow blowers. Specifically, the invention relates to a skid that is attached to the auger housing on the snow blower; where the skid includes sliding surface and a rolling surface that assist the auger housing to travel more easily over both snow covered regions and snow-free regions of the area being cleared, thereby making the blower easier to operate and less prone to damage during operation.

2. Background Information

A snow blower is a machine that is designed to lift snow and ice off a surface and to blow or throw the same some distance from the area that is being cleared. There are essentially two types of snow blowers. The first type is called a single-stage snow blower and this machine uses a scraper to lift snow from the surface being cleared. The lifted snow is then moved by an impeller through a discharge chute which directs snow away from the surface. The chute may be permanently fixed in a specific orientation or may be selectively directed by the operator. The second type of snow blower is a two-stage machine that also includes a metal auger that breaks up the snow or ice and cooperates with the scraper to lift the snow from the surface and draw the same into the machine, feeding it to the impeller. The impeller forces the lifted snow out of the discharge chute. A small motor drives the impeller and/or auger.

There are a number of problems that are experienced by operators of these machines. Snow blowers will typically function fairly well if the snow to be cleared is of a generally even depth. When there is a mixture of snow and ice on the surface to be cleared or if the surface includes patchy quantities of snow and ice, snow blowers can function in a less than optimum fashion. In these instances, when the snow blower moves from snow covered regions to regions with far less snow, the auger can tend to catch on the less snow-covered regions and drive portions of the scraper and auger housing into the surface. This can both damage the auger housing and scraper and can also damage the surface being cleared. This is particularly problematic if the surface being cleared is for example, stamped concrete or a surface that includes other decorative finishes. The scraping and scuffing of these surfaces can necessitate costly repairs. The damage to the snow blower can require that the auger housing, the auger and/or the scraper can need to be replaced or repaired. An additional issue with this type of situation is that the operator may temporarily lose full control of the machine as the auger bites into the surface.

It is known in the art to secure skids to the side walls of the auger housing on snow blowers to try and address this issue. An example of such a skid is disclosed in U.S. Pat. No. 7,540,102 issued to Olmr et al. This patent discloses skids that mounted on the lower, front corners of the housing side walls, close to the bottom edge thereof. The skids are adjustable so that they adequately contact the surface being cleared and control the distance between the surface being cleared and the bottom edge of the auger housing. The skids have a contoured bottom wall which enables them to slide over the surface that is to be cleared. This sliding motion in conjunction with keeping the bottom edge of the auger housing and scraper a small distance away from the surface aids in decreasing the tendency of the auger housing to bite into the surface. In this way, the skids aid in protecting ground-engaging regions of the auger housing and of the scraper from being damaged during use and also protect the surface from being damaged by the same.

Even though the above-mentioned device functions fairly well for the purposes for which it is intended, a problem still exists when the snow blower is used to clear a surface that includes areas that are essentially free of snow and ice mixed with areas that are covered with snow or ice. When these prior art devices are used on surfaces where there is patchy snow and icy conditions, when the skid contacts the concrete or asphalt surface it tends to grab and pull the machine. Not only is this tiring for the operator, but the snow blower then tends to scuff and scrape the surface being cleared. Stamped concrete surfaces are particularly vulnerable to this damage and the use of prior art devices on this type of surface can result in the need for costly, time-consuming repairs. Additionally, over time, the skids themselves are worn away or damaged by abrasion and gouging and, ultimately, the skids themselves may no longer effectively protect the auger housing and scraper from being damaged.

There is therefore a need in the art for an improved skid for a snow blower that will be less prone to being damaged as the snow blower moves between areas that are snow covered and areas that are essentially snow free.

SUMMARY OF THE INVENTION

The device of the present invention comprises a skid for use on a snow blower, where the snow blower includes an auger housing through which snow removed from an area is channeled. The skid includes a body that is secured to a vertical side wall of the auger housing. The body includes a sliding surface which assists the auger housing in sliding over snow-covered regions of the area being cleared; and a rolling surface which assists the auger housing to travel over snow-free regions of the area being cleared. A slot is provided in the sliding surface of the skid and a portion of the rolling surface projects for a distance below the sliding surface. An adapter plate may be positioned between the body and the side wall of the auger housing. The adapter plate enables the body to be secured to different makes of auger housing.

The skid in accordance with the present invention improves mobility and handling of the snow blower on exposed surfaces, works in both forward and reverse directions and reduces wear and tear on the skid surface while preventing scuffing and marking to the surfaces being cleared. The grinding and scraping cause by prior art skids is particularly damaging when these types of devices are used on decorative, stamped concrete surfaces that are becoming ever more popular in the construction of driveways, walkways and patios.

The objective of the present invention is to provide a skid device for a snow blower that includes a wheel feature located on at least one, and preferably both, side walls at the front of the snow blower machine. The wheel feature allows the snow blower to roll over surfaces with greater mobility. It reduces wear to the skid surface and prevents scuffing of the surface to be cleared.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
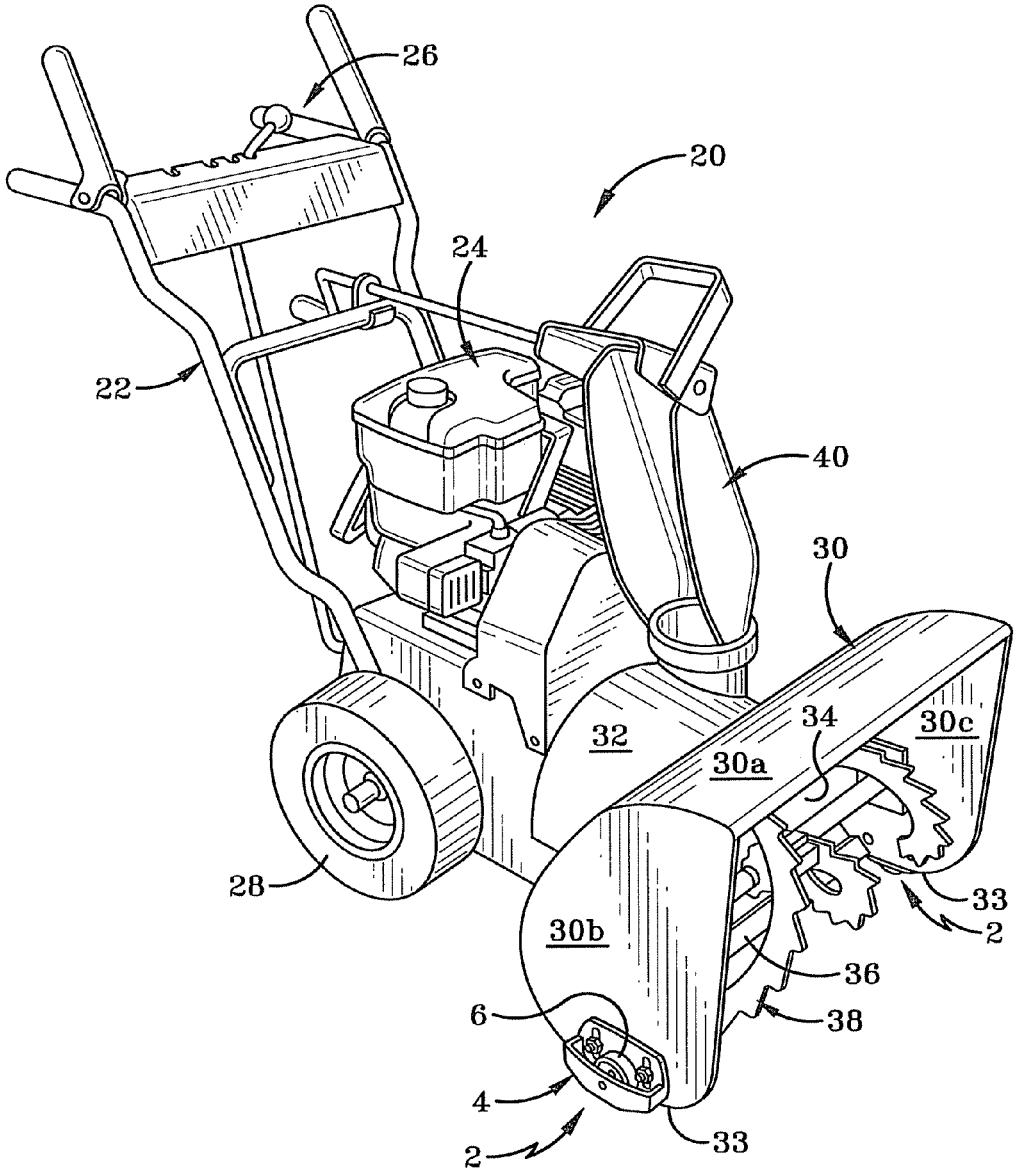
FIG. 1 is a perspective view of a hand-operable two-stage snow blower having a skid in accordance with the present invention mounted thereon.

Referring to FIG. 1, there is shown a snow blower 20 having a frame 22 on which is mounted a motor 24, a handle 26, and wheels 28 for moving the snow blower over a surface to be cleared of snow. An auger housing 30 is mounted at a front end of frame 22 and includes an upper wall 30*a* and a pair of opposing side walls 30*b*, 30*c*. Auger housing 30 further includes a second end wall (not shown) that is operationally connected to an impeller housing 32. Upper wall 30*a*, side walls 30*b*, 30*c* and the second end wall define an interior chamber 34. A scraper 36 is provided proximate a bottom end of the second end wall and extending between side walls 30*b*, 30*c*. A rotatable auger 38 extends between the interior surfaces of side walls 30*b*, 30*c* and is disposed rearwardly of a front entrance to chamber 34. Auger housing 30 is open at the front and at a bottom opposite upper wall 30*a* so that the auger 38 and scraper 36 can readily engage snow and ice on the surface to be cleared. Auger 38 and scraper 36 remove snow and ice from the surface and the auger 38 feeds the same into impeller housing 32. An impeller (not shown) is housed within impeller housing 32 and rotates to draw the removed snow into the snow blower and force it out of the same through a chute 40. Chute 40 preferably is directionally adjustable so that the removed snow can be blown or thrown some distance away from cleared surface. All of these component parts referenced in this paragraph are well known in the art and do not form part of the present invention.

Referring to FIGS. 1-12, a skid 2 in accordance with the present invention is adjustably mounted to an exterior surface of each of the side walls 30*b*, 30*c* of auger housing 30. Each skid 2 preferably is mounted adjacent a front end of housing 30 and proximate a bottom edge 33 of one of side walls 30*b*, 30*c* thereof.

Referring to FIGS. 2-9, the skid 2 in accordance with the present invention is shown in greater detail. Skid 2 comprises a body 4 that is adjustably secured to one of the vertical side walls 30*b*, 30*c* of auger housing 30. Body 4 includes a sliding surface that assists housing 30 in sliding over snow-covered regions of an area "S" (FIG. 10) that is to be cleared of snow by snow blower 20. Body 4 also includes a rolling surface that assists housing 30 in traveling over snow-free regions of area "S". The sliding surface on body 40 is comprised of portions of the front wall, rear wall and bottom wall of body 4, as will be hereinafter described. The rolling surface preferably comprises one or more wheels 6 mounted to body 4, where at least a portion of one or more of wheels 6 extends for a distance below the sliding surface. Each wheel 6 is rotatable about an axle 8 (FIG. 3) that is locked in place by a hitch pin 10 as will be hereinafter described.

In accordance with the present invention, body 4 is manufactured from any hard, rigid material including but not limited to, plastic and metal. Body 4 is made by any suitable fabrication method such as plastic molding, metal stamping or weldments. Body 4 is generally shaped as a rectangular, open-top box structure but could take on any other shapes, such as an oval or circular shape without departing from the scope of the present invention. The corners of body 4 are also preferably curved inward to minimize any direct impact which may occur in the process of maneuvering snow blower 20 in and around fixed objects. Body 4 has also been designed to be symmetrical to allow skid 2 to be mounted on either of the side walls 30*b*, 30*c* of auger housing 30 with substantially identical results.

Referring to FIGS. 2-9 and in accordance with the present invention, body 4 comprises a first side wall 50, a second side wall 52, a second end wall 54, a first end wall 56, and a bottom wall 58.

First side wall 50 is a substantially planar member having an interior surface 50*a* (FIG. 5), an exterior surface 50*b*, a top end 50*c* and a bottom end 50*d*. First side wall 50 is configured to abut the exterior surface of side wall 30*b* of auger housing 30. Consequently, if auger housing 30 was curved or shaped in any other fashion than being planar, then first side wall 50 would be complementary configured to that different shape. Top end 50*c* of first side wall 50 is substantially flat and bottom end 50*d* thereof is complementary in shape to bottom wall 58 of body 4 as will be hereinafter described. A pair of spaced apart slots 60 is defined in first side wall 50. Each slot 60 extends through first side wall 50 from interior surface 50*a* to exterior surface 50*b* thereof. Slots 60 preferably are substantially vertically oriented and are disposed substantially at right angles to the longitudinal axis "Y" of body 4. (It will be understood, however, that other orientations of slots 60 are contemplated to fall within the scope of the present invention.) Slots 60 are furthermore elongated and are spaced a distance inwardly from both of second end wall 54 and first end wall 56. It is contemplated that skid 2 of the present invention may be used to replace a prior art skid on the snow blower 20. Consequently, slots 60 preferably are spaced a distance apart from each other that will correspond to the spacing between pre-existing holes 35 (FIG. 9) defined in the side walls 30*b*, 30*c* of auger housing 30. Holes 35 would have been provided for the securement of the prior art skids. Skid 2 of the present invention differs from prior art skids in that slots 60 are of a greater width, as measured in a direction parallel to longitudinal axis "Y", than slots provided in previously known skids. Slots 60 are therefore able to be used to secure skid 2 to snow blowers that have either of a 2.75" and 3.00" bolt centers.

In accordance with another specific feature of the present invention, an aperture 62 is defined in first side wall 50 of body and is complementary sized and shaped to receive a first end 8*a* (FIG. 4) of axle 8 therein. Aperture 62 is disposed intermediate slots 60 and is equidistant from each of the slots 60. Aperture 60 preferably is also generally equidistant from top and bottom ends 50*c*, 50*d* of first side wall 50. It should be noted that aperture 62 may simply be a depression formed in exterior surface 50*b* of first side wall 50 or it may be a through-hole that extends from exterior surface 50*b* through to interior surface 50*a* thereof.

The shape of the preferred embodiment of body 4 preferably includes a curved second side wall 52 spaced a distance away from first side wall 50. The curved shape of second side wall 52 aids in minimizing the obtrusion of the leading edges of body 4 in an effort to deflect any direct impact on body 4 which may occur in the process of maneuvering snow blower 20 in and around fixed objects. Second side wall 52 is longitudinally curved so that when body 4 is viewed from the top, such as in FIG. 4, second side wall 52 curves outwardly away from first side wall 50 and is generally convex in shape. Second side wall 52 has an interior surface 52*a*, an exterior surface 52*b*, a top end 52*c* and a bottom end 52*d*. Second side wall 52 is substantially shorter than first side wall 50 in that top end 52*c* thereof is spaced a distance downwardly away from top end 50*c* of first side wall 50. The shorter second side wall 52 enables an operator to more easily access slots 60 in order to secure and adjust the position of skid 2 on auger side walls 30*b*, 30*c*, as will be hereinafter described. Top end 52*c* of second side wall 52 is also substantially flat and is disposed generally parallel to top end 50*c* of first side wall 50. Bottom end 52*d* of second side wall 52 is substantially aligned with bottom end 50*d* of first side wall 50 and both of these bottom ends are complementary in shape to the cross-sectional shape of bottom wall 58 of body 4 and are aligned therewith, as will be hereinafter described.

In accordance with yet another feature of the present invention, second side wall 52 defines an aperture 64 (FIG. 3) therein that is complementary sized and shaped to receive a second end 8*b* of axle 8 therein. Aperture 64 is located generally centrally on second side wall 52 between rear and first end walls 54, 56 and is generally equidistant from top end 52*c* and bottom end 52*d*. Aperture 64 is also aligned with aperture 62 in first side wall 50 in such a way that axle 8 is disposed substantially at right angles to longitudinal axis "Y" when engaged in body 4. It is to be understood that aperture 64 may be defined as a depression on interior wall 52*a* of second side wall 52 or may be a through-hole that extends between interior and exterior surfaces 52*a*, 52*b* thereof. Preferably, aperture 64 is a through-hole in second side wall 52.

Bottom wall 58 is provided with three distinct faces, namely a central face 58*a*, a first face 58*b* and a second face 58*c*. First and second faces 58*b*, 58*c* preferably are angled upwardly from central face 58*a* to prevent body 4 from digging into the snow when snow blower 20 is moving in either of a forward and a backward direction. Central face 58*a* is substantially flat and oriented generally parallel to top ends 50*c*, 52*c* of first and second side walls 50, 52. First face 58*b* extends outwardly from a first end of central face 58*a* and is disposed at a first angle "A" of between 25 and 35 degrees relative thereto. Preferably, first face 58*b* is disposed at an angle of 30 degrees relative to central face 58*a*. Similarly, second face 58*c* extends outwardly from a second end of central face 58*a* and is disposed at a second angle "B" of between 25 and 35 degrees relative thereto. Preferably, second face 58*c* is disposed at an angle of 30 degrees relative to central face 58*a*. Both of first and second faces 58*b*, 58*c* angle upwardly from opposite ends of central face 58*a* and terminate in front and second end walls 56, 54 respectively.

In accordance with a specific feature of the present invention, a longitudinally extending slot 66 (FIGS. 5 & 8) is defined in central face 58*a* of bottom wall 58. Slot 66 extends between an interior surface and an exterior surface of central face 58*a* and is configured to receive a portion 6*a* of wheel 6 therethrough in the manner illustrated in FIGS. 2-8. Slot 66 preferably is elongated in a longitudinal direction and is provided with rounded first and second ends and slightly curved sides. This configuration of slot 66 reduces the possibility of gravel or rock salt from becoming jammed between wheel 6 and those portions of central face 58*a* that define slot 66 as these jammed materials could possibly prevent wheel 6 from turning.

In accordance with yet another specific feature of the present invention, first side wall 50, second side wall 52, rear and first end walls 54, 56 and bottom wall 58 bound and define a chamber 68 (FIG. 2) in body 4. Chamber 68 is, at a minimum, greater in length than the diameter "D" (FIG. 6) of wheel 6, where the length is measured between rear and first end walls 54 and 56. Additionally, chamber 68 is, at a minimum, greater in width than the width "W" of wheel 6, where the width of the chamber 68 is measured between side walls 50, 52. It should be noted that slot 66 in central face 58*a* is wider than width "W" of wheel 6 but may be of a shorter length than the diameter "D" of the wheel 6.

Figure 3:
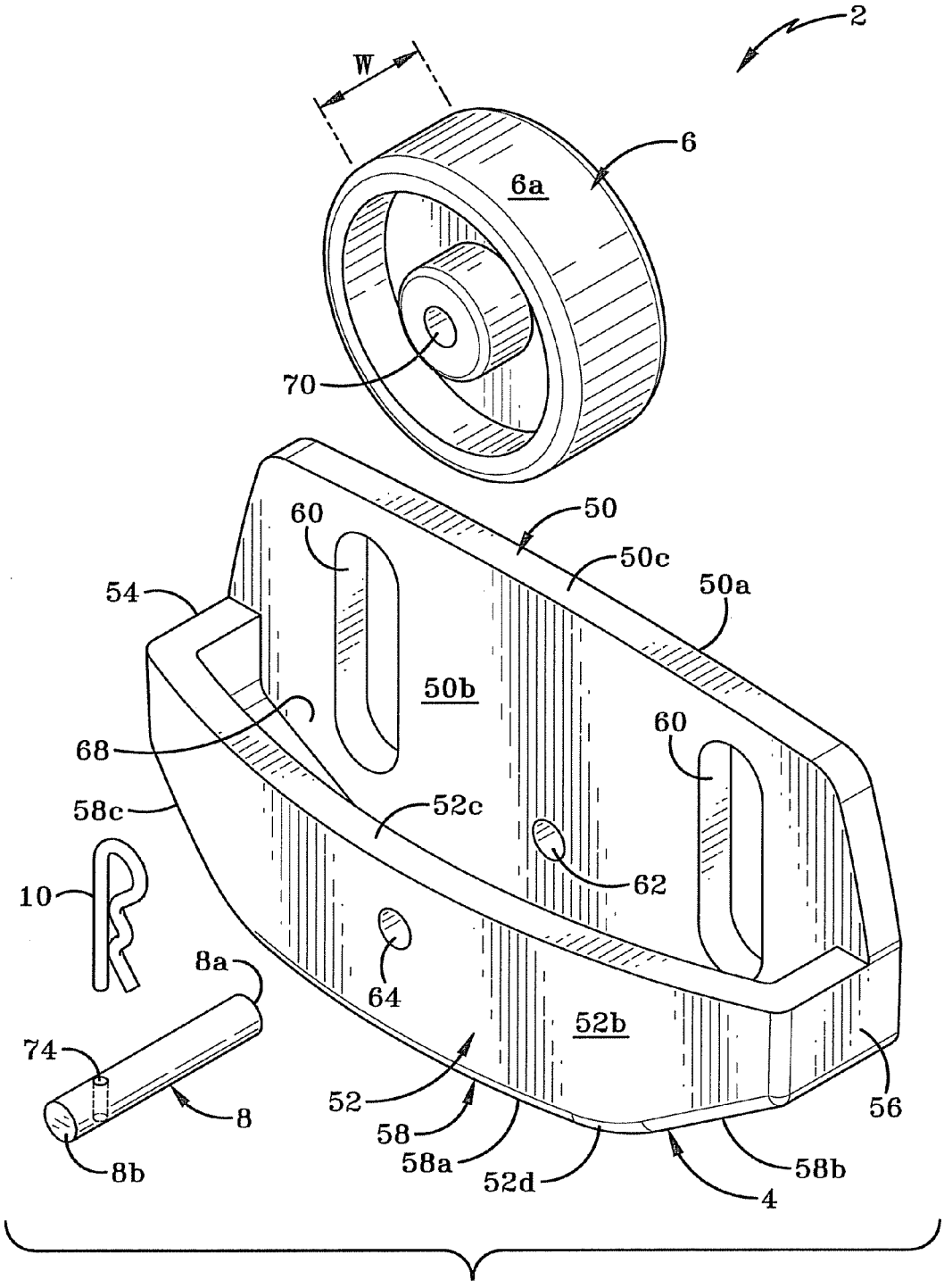
FIG. 3 is an exploded perspective left side view of the skid.
Figure 4:
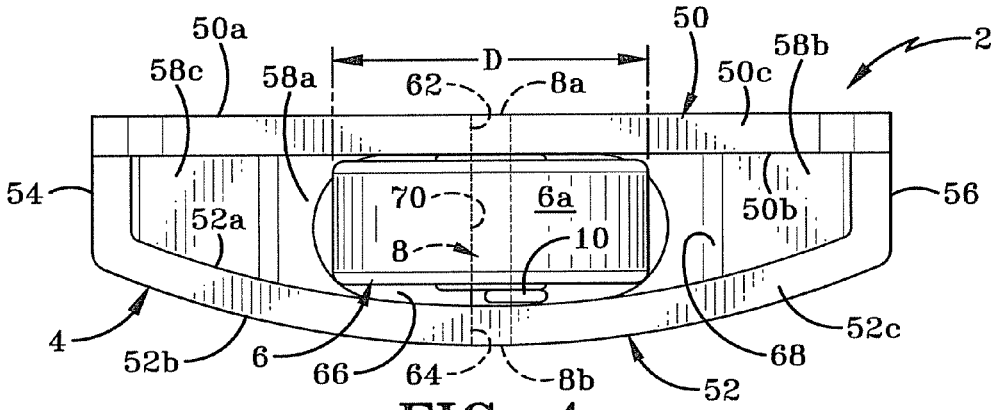
FIG. 4 is a top view of the skid.
Figure 5:
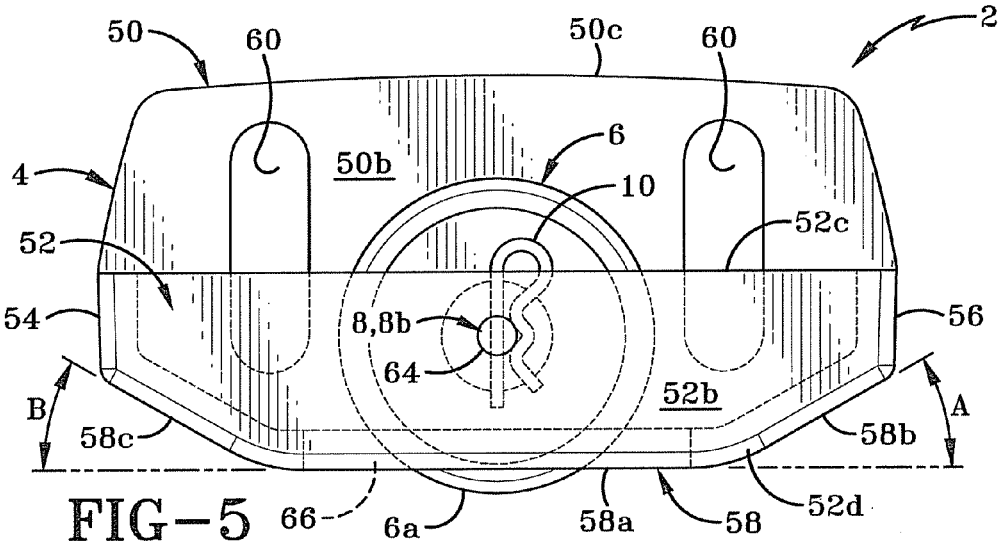
FIG. 5 is a left side view of the skid.
Figure 6:
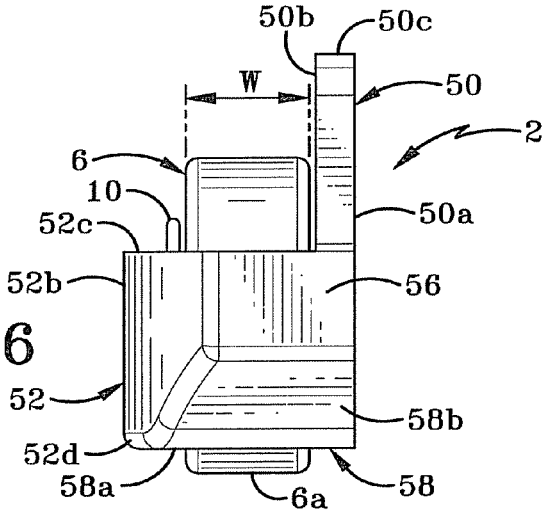
FIG. 6 is a front view of the skid.
Figure 7:
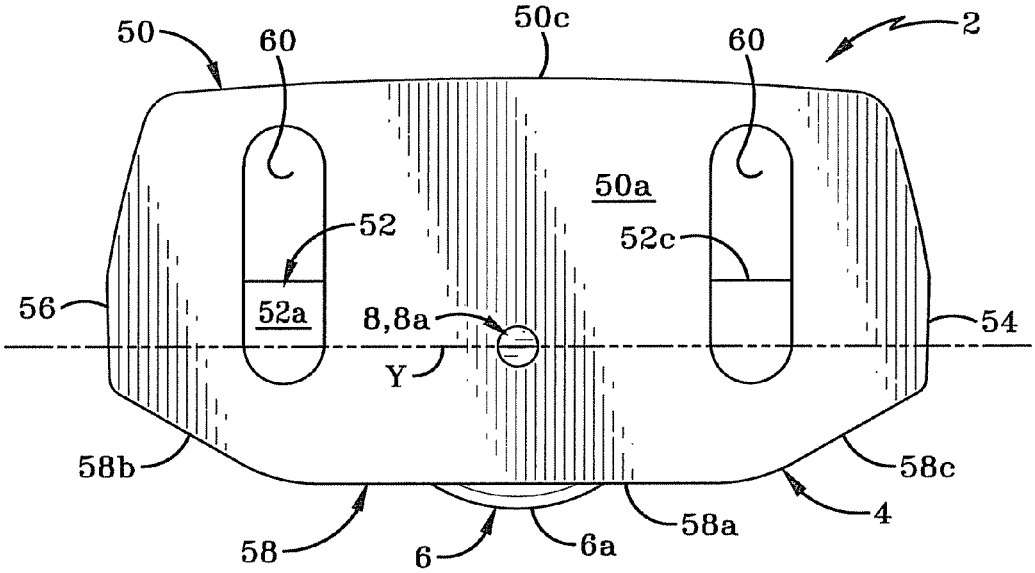
FIG. 7 is a right side view of the skid.
Figure 8:
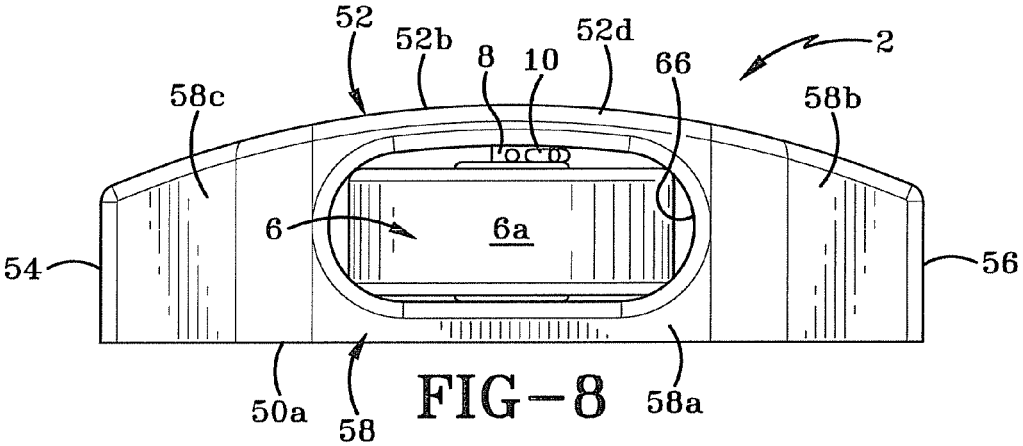
FIG. 8 is a bottom view of the skid.
Figure 9:
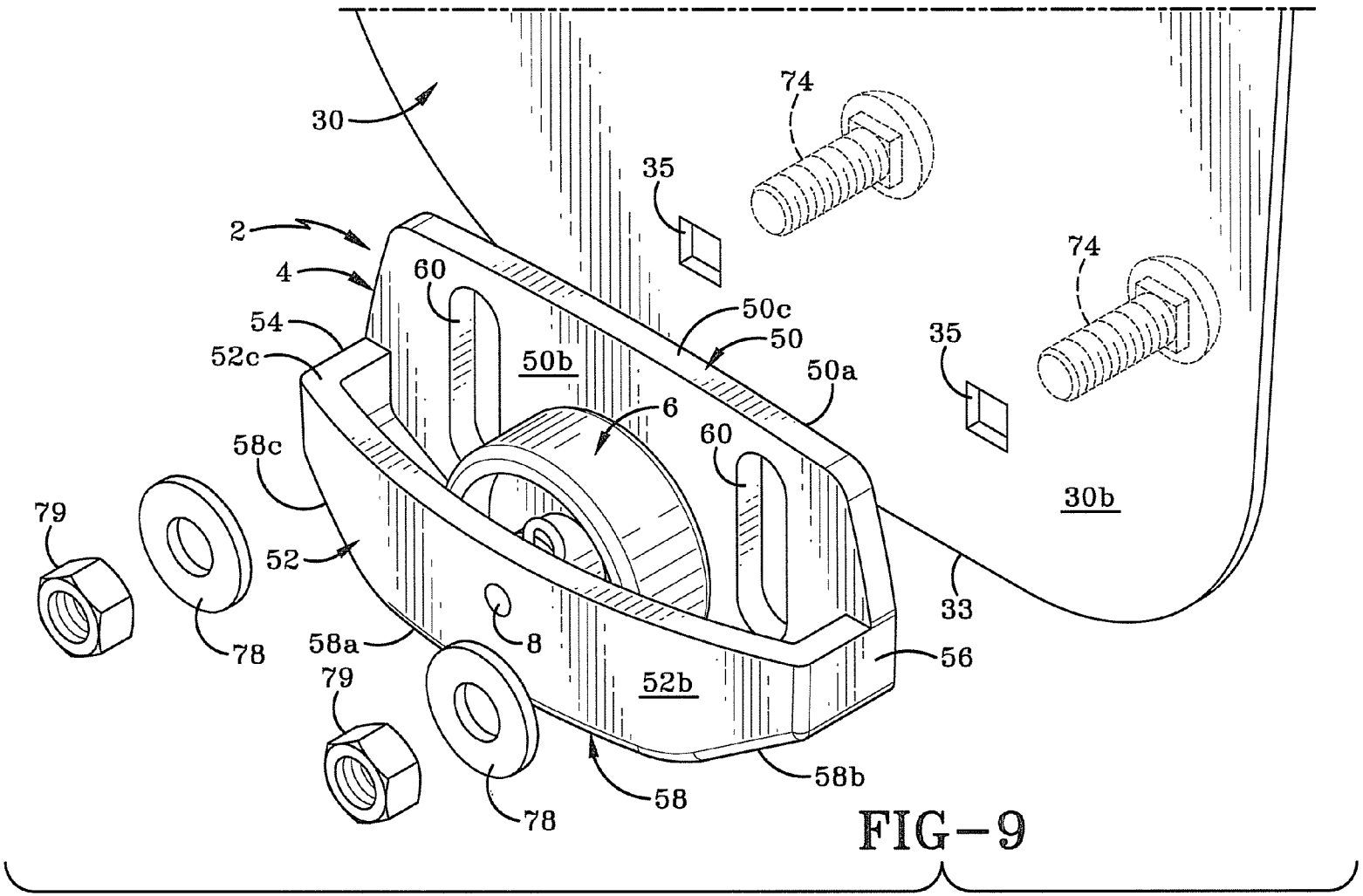
FIG. 9 is an exploded perspective left side view of the skid being mounted on a left side wall of the auger housing of the snow blower.

FIG. 3 shows how skid 2 is assembled. Wheel 6 is positioned in chamber 68 so that a hole 70 in wheel 6 is aligned with apertures 64, 62 in second side wall 52 and first side wall 50, respectively. Axle 8 is inserted through aperture 64, through hole 70, and into aligned aperture 62. First end 8*a* of axle 8 is engaged in aperture 62. When second end 8*b* of axle 8 is aligned with the exterior surface 52*b* of second side wall 52, then hitch pin 10 is engaged in through-hole 74 in axle 8 so that axle cannot be withdrawn from holes 64, 62.

When skid 2 is assembled, at a least a portion 6*a* of wheel 6 extends downwardly through slot 66 and beyond a lowermost surface of central face 58*a* of bottom wall 58. This portion 6*a* of wheel 6 when placed upon "S" (FIG. 10) will retain bottom wall 58 a distance above "S". Wheel 6 has a circumferential surface that progressively comes into contact with the ground beneath snow blower 20 as the wheel rotates.

It is this circumferential surface that comprises the rolling surface of skid 2. It should be noted that depending on the surfaces being cleared by snow blower 20, wheel 6 can be made of metal or softer materials such as plastic, rubber, polyurethane etc. Wheel 6 is protected by the shorter second side wall 52 from impact with objects that may be buried in the snow or simply disposed alongside the pathway that is being cleared by snow blower 20.

Figure 2:
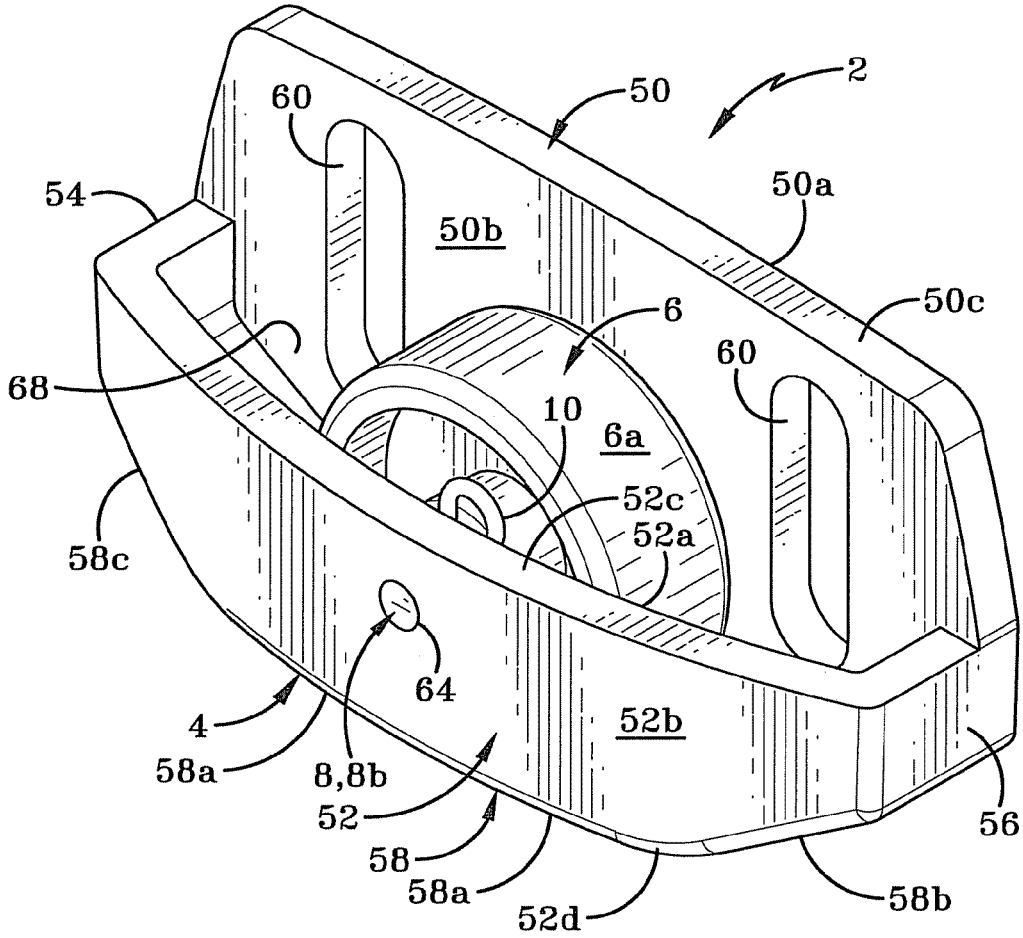
FIG. 2 is a perspective side view of the skid in accordance with the present invention.

Once skid 2 is fully assembled, as shown in FIG. 2, it may then be engaged with one of the side walls 30*b*, 30*c* of auger housing 30. FIGS. 1, and 9-13 show skid 2 being mounted onto side wall 30*b* of auger housing 30. Skid 2 is mounted on side wall 30*b* by inserting each of a pair of bolts 74 through one of holes 35 in side wall 30*b*, and through a slot 60 in first side wall 50 of skid 2. A washer 78 is engaged with the bolt shaft and then a nut 79 is used to loosely latch each bolt 74 in place. As is evident from FIG. 10, when skid 2 is engaged with side wall 30*b* of auger housing 30, skid 2 preferably will retain the bottom edge 33 of side wall of auger housing 30 a distance above the "S" upon which skid 2 rests so that a gap is created between bottom edge 33 and the top of the "S". It will be understood that because slots 60 are elongated in a direction disposed at right angles to the longitudinal axis "Y" of skid 2, it is possible to adjust the size of the gap between bottom edge 33 and "S". This adjustment is accomplished simply by sliding skid 2 upwardly or downwardly along side wall 30*b* when bolts 74 are loosely latched therewith. When the correct location is achieved, nuts 79 are tightened, locking bolts 74 in that location in slots 60. If it is found that the gap between bottom edge 33 and "S" is incorrect, then the operator can simply loosen nuts 79 and slide skid 2 to the correct location and then tighten nuts 79 once again.

Figure 10:
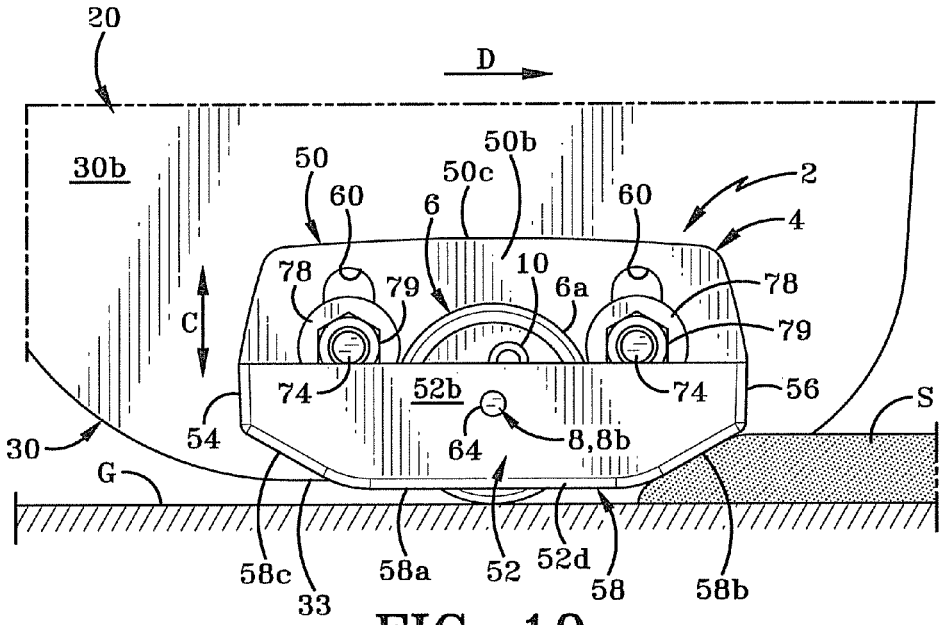
FIG. 10 is a left side view of the skid and auger housing shown approaching a snow bank.
Figure 11:
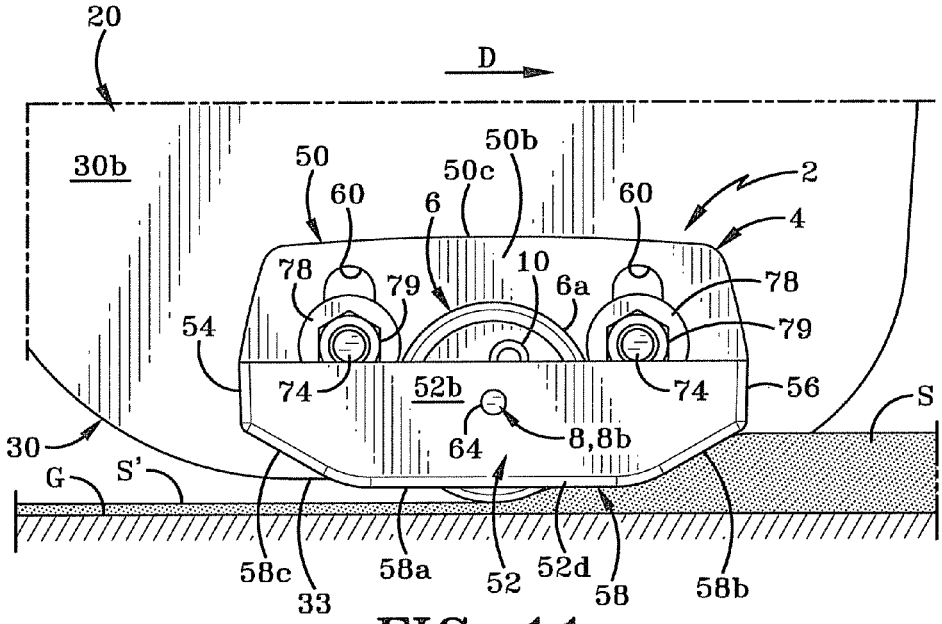
FIG. 11 is a left side view of the skid and auger housing shown at a point where the snow blower has removed a portion of the snow from the snow bank.

FIGS. 10-13 show skid 2 in use on auger housing 30. FIG. 10 is a left side view of the skid 2 mounted on side wall 30*b* of auger housing 30 moving over a surface that includes a first region "S" that is covered with snow and a second region "G" that is snow-free. The snow blower is pictured moving in the direction of arrow "D". The angled first face 58*b* of skid 2 encounters the snow in the first region "S" and the angled face partially compresses the snow it encounters and compresses the same. As the snow blower continues to move in the direction of arrow "D", the sliding surface of the skid 2, comprised of first face 58*b* and central face 58*a* slides or glides over the snow that is being compressed thereby and thus assists auger housing 30 to move forward more easily into the snow. Wheel 6 further compresses some of the snow that slides under first face 58*b* and central face 58*a* and this further compressed snow is indicated by the reference character S'. A strip of the compressed snow S' trails the snow blower.

Figure 12:
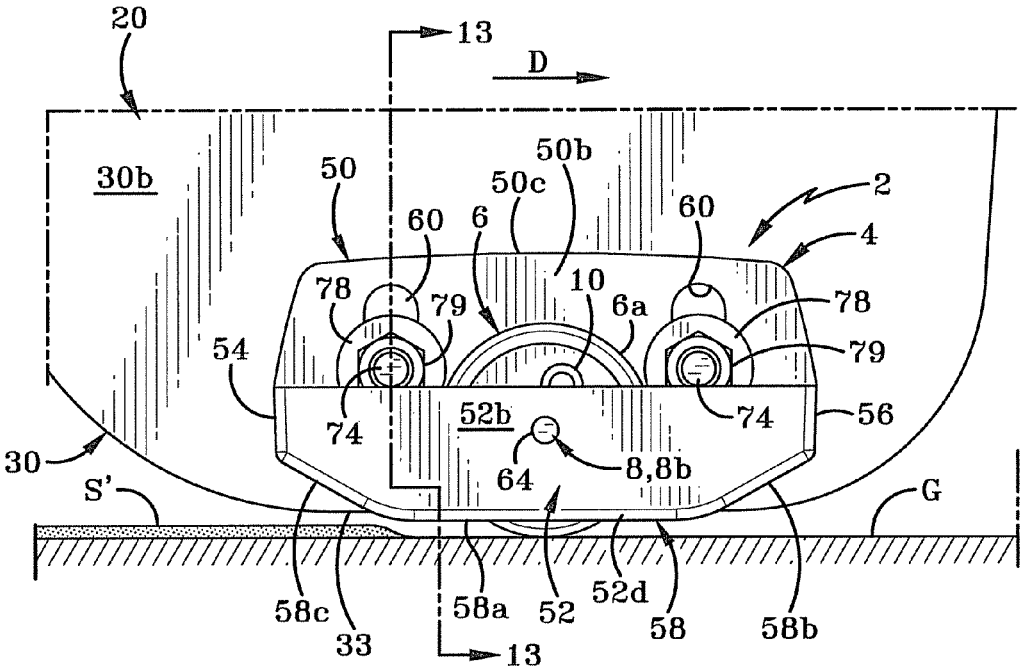
FIG. 12 is a left side view of the skid and auger housing shown where the snow blower is moving from a snow-covered surface to a snow-free surface.
Figure 15:
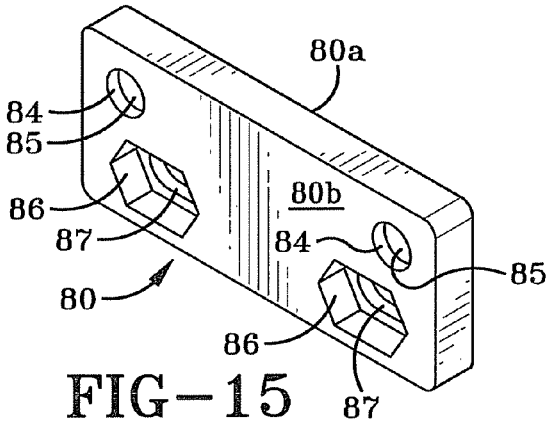
FIG. 15 is a perspective left side view of the adapter plate of FIG. 14.

FIG. 12 illustrates what happens when the snow blower continues to move forwardly in the direction of arrow "D" and encounters a snow-free surface "G". Because ground surfaces that are being cleared of snow and ice are typically made from concrete and/or asphalt, the friction is significant enough to cause the wearing away of plastic or metal surfaces of previously known skids. In these previously known devices, when the surface being cleared is a snow-free region, such as is shown by surface "G" in FIG. 12, then the bottom surface of the prior art skid and the bottom edge of the auger housing would have been dragged along the snow-free region "G" by the snow blower advancing along that surface. The dragging motion along this surface "G" would have caused the bottom surface of that prior art skid to be worn away, gouged and cut by the snow-free surface "G", ultimately leading to damage and destruction of the prior art skid.

Additionally, in previously known snow blowers, when such a snow-free surface "G" was encountered, the front end of the auger housing would tend to bite into the snow-free surface "G" and the auger within the auger housing would tend to damage that snow-free surface. In the present invention, however, the rolling surface of skid 2 substantially prevents this from happening. As is evident from FIG. 12, instead of bottom wall 58 of skid 2 contacting snow-free surface "G", the portion 6*a* of wheel 6 is brought into abutting contact with the surface "G". The advancing snow blower causes wheel 6 to rotate and this assists the snow blower in advancing quickly and easily over the surface "G". The rolling surface, being the circumferential surface of wheel 6, engages the snow-free surface "G" and, since the portion 6*a* of the wheel 6 extends for a distance between the bottom edge 33 (FIG. 13) of the side wall 30*b* of housing 30, the bottom edge 33 is retained that distance above snow-free surface "G". Consequently, the auger in auger housing 30 does not tend to bite into the snow-free surface "G" and surface "G" is therefore spared the damage that would have been caused by previously known devices. Additionally, the sliding surface of skid 2, bottom wall 58, is retained a distance above the snow-free surface "G". Thus, as the snow blower advances in the direction "D", the sliding surface of skid 2 is also prevented from being dragged along snow-free surface "G" and damage to the skid 2 is therefore also substantially prevented.

When the snow blower subsequently engages snow on the surface being cleared, the ski-type action or sliding action of skid 2 once again resumes. The rotating wheel and the sliding action of skid 2 assist the snow blower in advancing across any type of surface, whether snow-covered or snow-free. Additionally, the presence of wheel 6 makes it possible for the snow blower to be more easily maneuvered over rougher or uneven terrain and around objects. Prior art skids which lack the rolling surface of the present invention, would simply land up biting into depressions in the surface being cleared and could possibly even cause the snow blower to become less maneuverable.

It will be understood that because the shape of skid 2, the sliding surface and rolling surface work equally well when the snow blower is moved in the opposite direction from that indicated by arrow "D". This is because the second face 58*c* is angled in the same manner as the first face 58*b* and functions in the same way as first face 58*b*. When the second face 58*c* encounters snow, it cuts into and slides over that snow in the same way as first face 58*b*. When the snow blower moves onto a snow-free surface "G", the rolling surface, wheel 6, is caused to rotate in the opposite direction and thereby aids the snow blower in moving in the opposite direction while holding the bottom edge 33 of auger housing 30 a distance from the snow-free surface "G" and holding the sliding surface of the skid the distance away from surface "G" as well.

Thus, skid 2 provides both a sliding feature as well as a rolling feature to the forward portion of snow blower 20 depending on the amount of snow and/or ice present while performing the task of clearing driveways, walkways, patios, etc. of snow and ice. If sufficient amounts of snow and/or ice are present, the sliding feature of the device will function to allow the front portion of snow blower 20 to glide over the surface being cleared. Conversely, when insufficient amounts of snow and ice are present, the friction created between wheel 6 and the exposed snow-free ground surface "G" will cause wheel 6 to turn on axle 8 and allow the front portion of snow blower 20 to roll over ground surface "G". Skid 2 thus makes the handling and maneuverability of snow blower much easier for the operator. The skid 2 also increases the control of snow blower 20 because it reduces the drag and pulling forces that would normally occur when the housing and auger travel over an abrasive surface.

It will be understood that the skid 2 in accordance with the present invention can be utilized on any device or machine that skids, glides or rolls along a surface. Generally, any device that uses a set of skids can benefit from the addition of a slightly protruding wheel feature in accordance with the present invention Skid 2 is used in guiding the movement of snow blower 20 in both forward and reverse directions as well as in turning or maneuvering the snow blower. Unlike a fixed skid such as those known in prior art devices, it also allows snow blower 20*e* to be handled in a similar fashion to a hand truck. This is done by lifting upward on the handles 26 of snow blower 20 and rolling the snow blower using the wheels 6 of the skid 2 only. This also allows the operator to maneuver in and around tight spaces. Additionally, because the device of the present invention tends to roll and slide instead of just sliding, it tends to last much longer than previously known devices.

It will be understood that various wheel materials, diameters and configurations are possible for use in different environments and under different types of conditions. For example, rubber treaded wheels could be utilized on fragile or unstable surfaces. It should further be understood that while skid 2 is disclosed as including a single wheel 6, the skid could be provided with more than one wheel to aid it in traveling over snow-free surfaces. This plurality of wheels could also take the form of rollers or wheels mounted in a track.

Referring to FIGS. 14-17, there is shown an alternative method of securing skid 2 to a side wall 130*b* of auger housing 130 that includes utilizing a first embodiment of adapter plate 80. Adapter plate 80 is utilized when the spacing between slots 60 does not correspond to the spacing between holes 135 on side wall 130*b* of auger housing 130. Adapter plate 80 makes it possible to mount skid 2 on a wide variety of different types of snow blowers that are made by different manufacturers.

Figure 16:
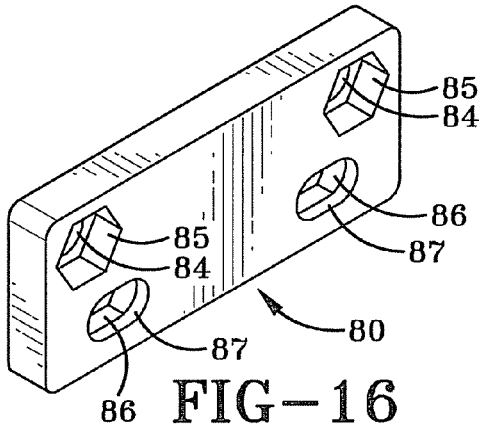
FIG. 16 is a perspective right side view of the adapter plate of FIG. 14.
Figure 17:
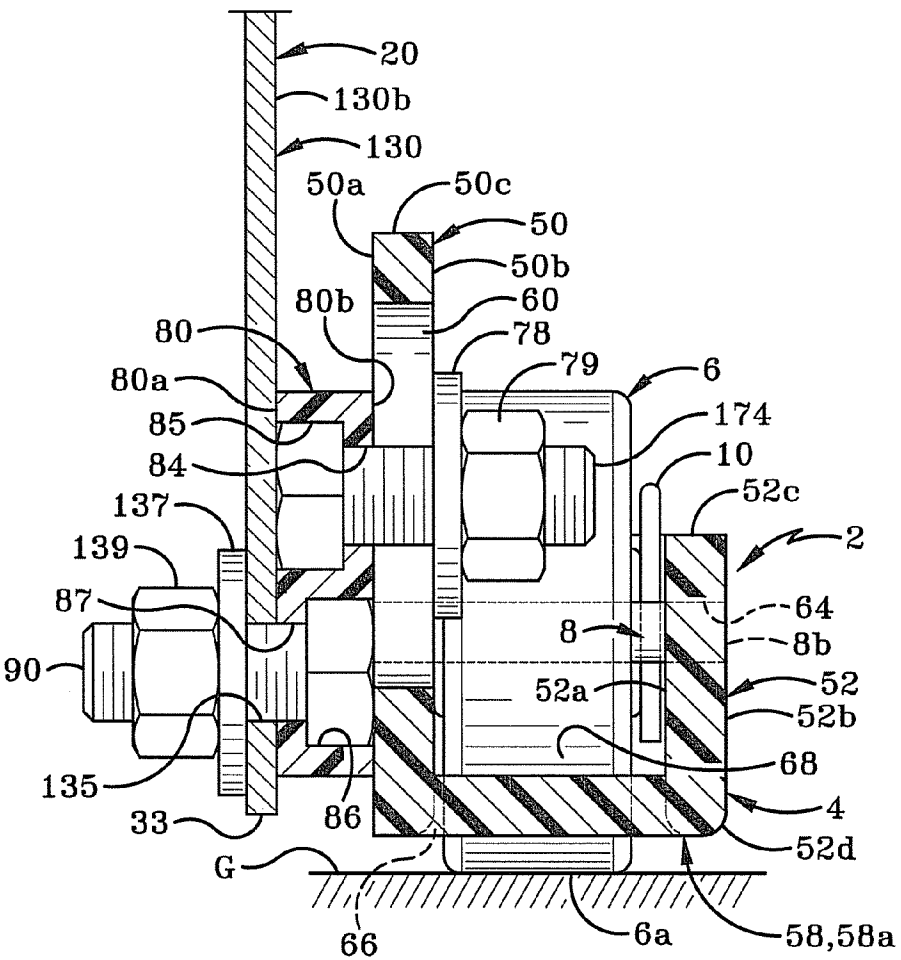
FIG. 17 is a cross-sectional front view of the skid and auger housing with the adapter plate of FIG. 14 disposed therebetween.
Figure 13:
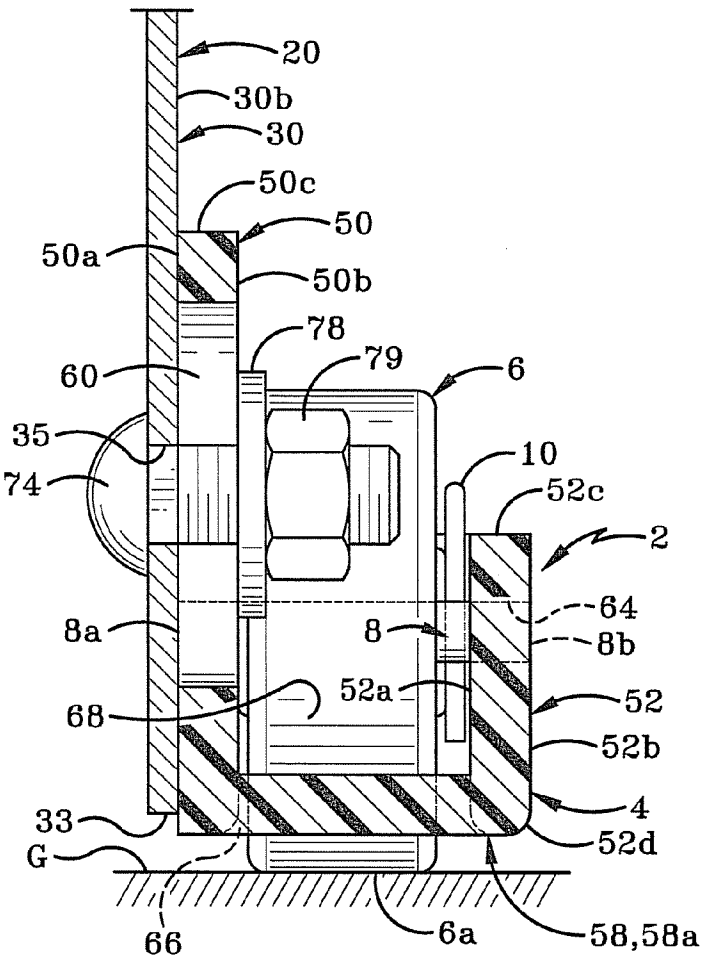
FIG. 13 is a cross-sectional front view of the skid and auger housing taken through line 13-13 of FIG. 12.

In accordance with the present invention, adapter plate 80 is a substantially planar member having first and second side surfaces 80*a*, 80*b*. A first set of holes 84 is defined in adapter plate 80 and these holes extend between first side surface 80*a* and second side surface 80*b*. Holes 84 are oriented substantially at right angles to the longitudinal axis of the plate 80. (The longitudinal axis of the plate 80 is oriented substantially parallel to the longitudinal axis "Y" of skid 2.) Holes 80 preferably are generally circular in shape on second surface 80*b* (FIG. 15) and are shaped complementary to the shape of a head of a bolt 174 (FIG. 14) that is used to secure adapter plate 80 to skid 2. So, for example, as is illustrated in FIG. 16, holes 84 include a recessed hexagonal region 85 on first surface 80*a* of adapter plate 80 in order to accommodate the hexagonal head of bolt 174. If the bolt had a square head or a circular head, then the recessed region 85 would be complementary sized and shaped. Essentially, when bolt 174 is engaged with adapter plate 80, no portion of the head of that bolt 174 will protrude beyond first surface 80*a*. This ensures that first surface 80*a* will abut the exterior surface of side wall 130*b* of auger housing 130 when skid 2 is mounted thereon. Holes 84 are spaced a first distance longitudinally from each other. This first distance corresponds to the distance between slots 60 in first side wall 50 of skid 2.

Figure 14:
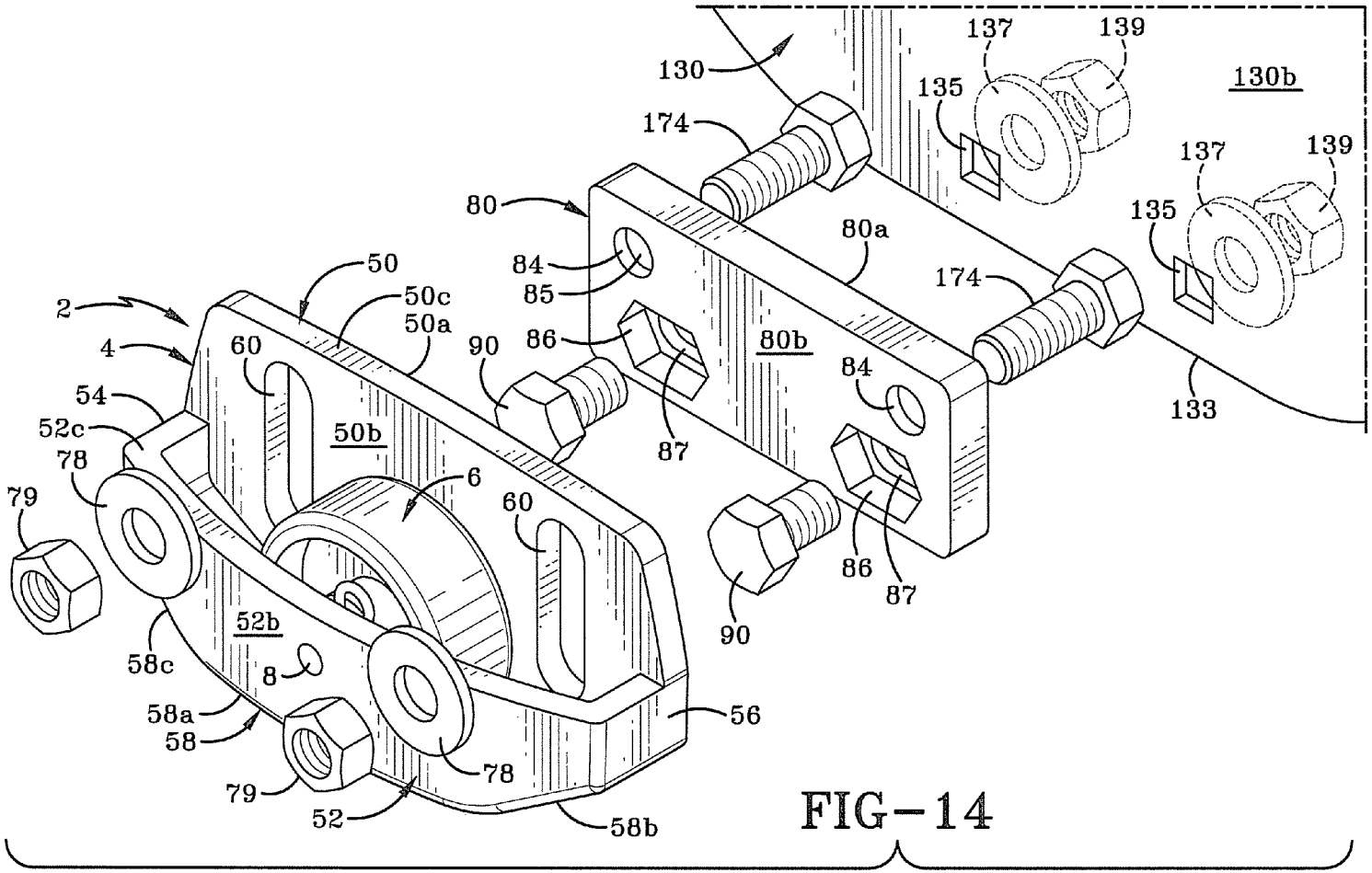
FIG. 14 is an exploded left side perspective view of an alternative manner for securing the skid to the side wall of an auger housing utilizing a first embodiment of an adapter plate.

Adapter plate 80 further defines a second set of holes 86 that are longitudinally elongated and are spaced a second distance apart from each other. Holes 86 are vertically spaced a distance beneath holes 84. Holes 86 include a generally elliptical slot 87 on first surface 80*a* and a generally hexagonal-ellipse on second surface 80*b*. The hexagonal-ellipse is recessed into second surface 80*b* so that when a bolt 90 is engaged with adapter plate 80 to secure the same to side wall 130*b*, the head of that bolt 90 will not extend outwardly beyond second surface 80*b*. This, again, ensures that first side wall 50 of body 4 will be in abutting contact with second surface 80*b* when skid 2 is mounted on side wall 130*b*. Once again, it should be understood that bolts having heads shaped other than is illustrated in FIG. 14 can also be utilized and that the shape of the recessed region of holes 86 will be provided so that it is complementary shaped thereto.

When adapter plate 80 is to be used, bolts 90 are inserted through holes 86 and then bolts 174 are inserted through holes 84, through slots 60 and are then secured loosely in place by way of washers 76 and nuts 79. The location of skid 2 on adapter plate 80 can be adjusted by loosening nuts 79 and sliding adjuster plate 80 upwardly or downwardly. This movement causes the shaft of bolts 174 to travel along slots 60. When the correct positioning between adapter plate 80 and skid 2 is determined, nuts 79 are tightened to lock the two components together. The adapter plate 80 is then secured to side wall 130*b* by inserting bolts 90 through are protruding out of first surface 80*a* through holes 86 and through holes 135 in side wall 130*b*. A second washer 137 and nut 139 is then used to lock each bolt 90 in place. The elongated, elliptical shape of holes 86 allows bolts 90 to be slid longitudinally within holes 86 to a position where the distance between bolts 90 substantially corresponds to the distance between holes 135. This adjustability makes it possible for skid 2 to be secured to different makes of snow blower that have their holes 135 set at different distances from each other. When nuts 139 are tightened, skid 2 and adapter plate 80 are tightly retained on auger housing and snow blower 20 can be used in the manner previously described. If and when it is desired to remove skid 2 from auger housing 130, nuts 79 and 139 are removed and skid 2 and adapter plate 80 are pulled off side wall 130*b*.

Figure 18:
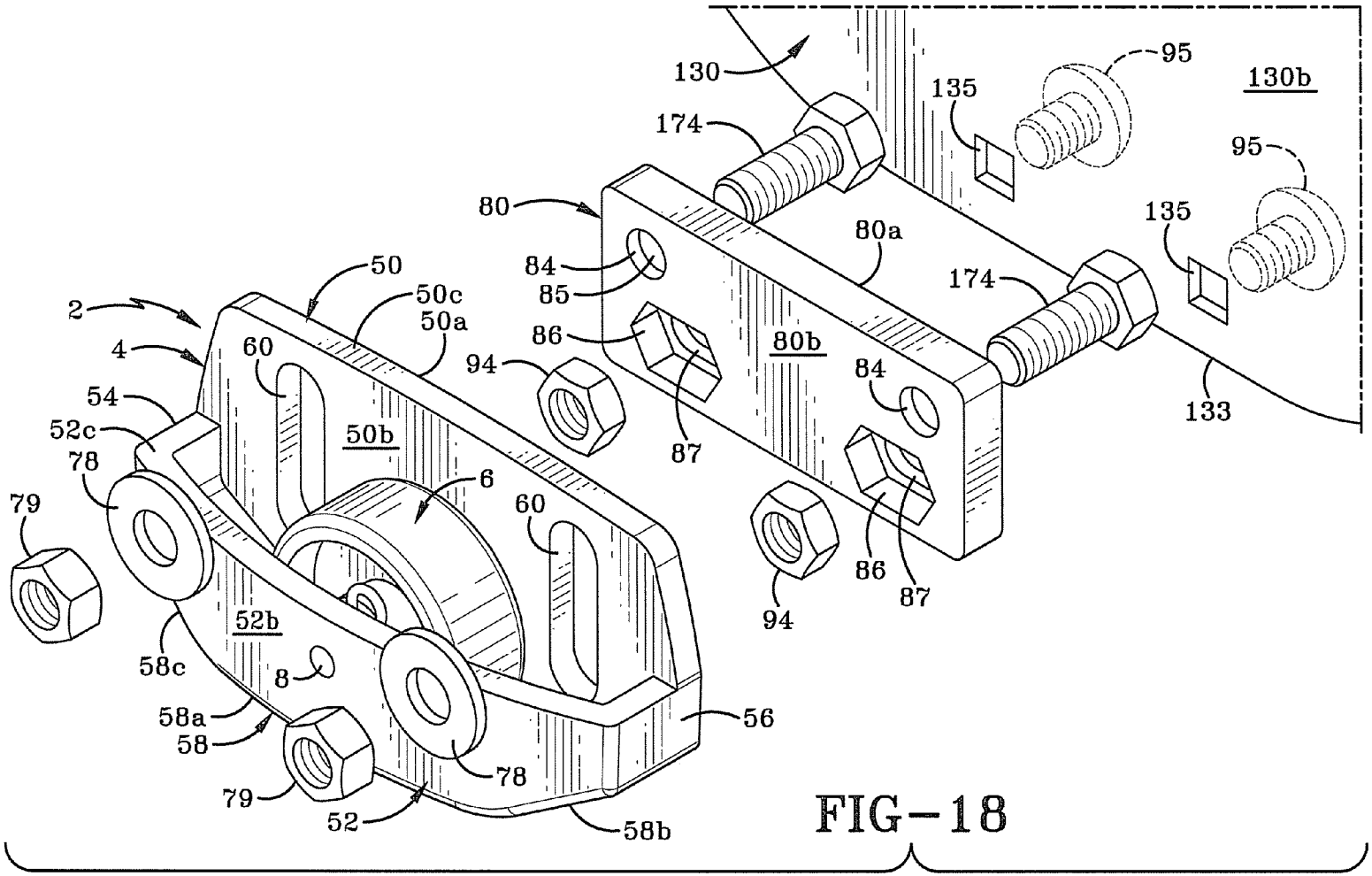
FIG. 18 is an exploded left side perspective view of an alternative manner for securing the skid to the side wall of an auger housing utilizing the first embodiment of the adapter plate.

FIG. 18 shows a second manner of securing adapter plate 80 to side wall 130*b*. In this instance, nuts 94 are inserted into the recessed region of holes 86 in second surface 80*b*. Skid 2 and adapter plate 80 are secured together in the manner described above by inserting bolts 174 through holes 84 and locking them loosely in place using washers 78 and nuts 79. Bolts 95 are inserted through holes 135 in side wall 139*b*, through holes 86 and are engaged in nuts 94. Bolts 95 preferably are of a slotted head or socket head type. It should be understood that the nuts 94 may be configured to be permanently retained within the recessed region of holes 86 but are slidable back and forth along the length of the holes so that the distance between the two nuts 94 can be adjusted to correspond to the distance between holes 135.

Figure 19:
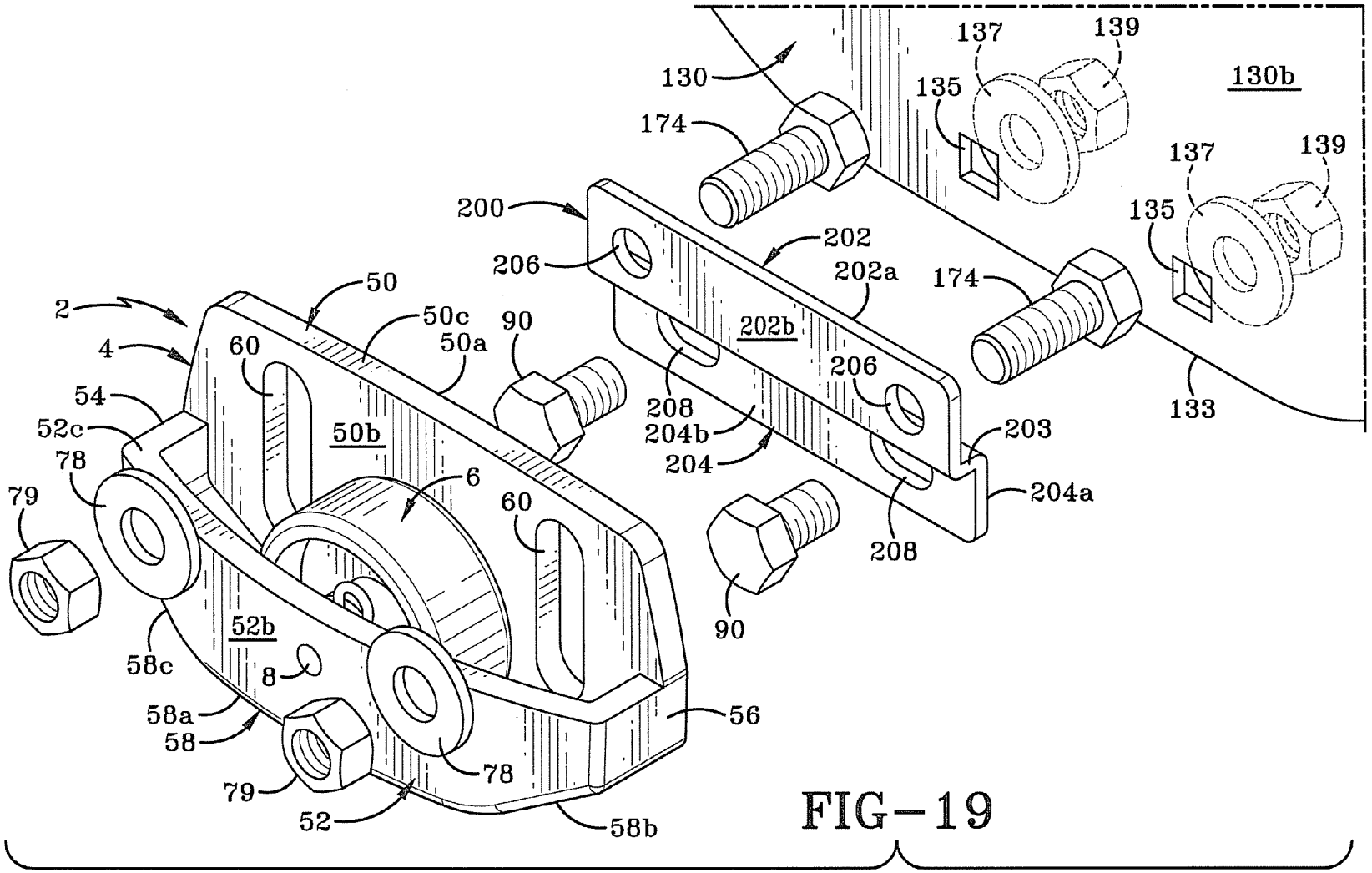
FIG. 19 is an exploded left side perspective view of an alternative manner for securing the skid to the side wall of an auger housing utilizing a second embodiment of an adapter plate.

FIG. 19 shows a second embodiment of an adapter plate in accordance with the present invention, generally indicated at 200. Adapter plate 200 is manufactured from metal and is substantially thinner than adapter plate 80. Additionally, adapter plate 200 includes a planar first region 202 and a planar second region 204 that are each vertically oriented and are horizontally offset relative to each other. First and second regions 202, 204 are joined together by a third region 203 that is disposed horizontally between them. Third region 203 is of a depth that is sufficient to ensure that the head of bolt 174 will not project passed the surface 204*a* of second region 204, and so that the head of bolt 90 will not project passed surface 202*b* of first region 202. First region 202 defines a pair of generally circular holes 206 therein. Holes 206 are spaced a first distance longitudinally from each other and extend between first surface 202*a* and second surface 202*b* of first region 202. Second region 204 defines a second set of holes 208 therein. Holes 208 are spaced a second distance longitudinally from each other and are longitudinally elongated. Second holes 208 are disposed vertically beneath from first holes 206 and are generally aligned therewith. Second holes 208 extend between first surface 204*a* and second surface 204*b* of second region 204.

Skid 2 is secured to first region 202 of adapter plate 200 by inserting bolts 90 through holes 208 and then placing second surface 202*b* of adapter plate 200 against first side wall 50 of body 4. Bolts 174 are then inserted through holes 206, through slots 60, through washers 78 and through nuts 79. When nuts 79 are tightened, skid 2 is secured to adapter plate 200. As has been previously described, adapter plate 200 can be positioned at different vertical locations on the first side wall 50 of skid 2 by sliding the two components relative to each other when nuts 79 are only loosely engaged with bolts 174 and bolts 174 are therefore able to slide vertically along slots 50. Second region 204 of adapter plate 200 is placed against side wall 130*b* so that first surface 204*a* thereof abuts the exterior surface of side wall 130*b* and so that the shafts of bolts 90 that extend beyond first surface 204*a* are received through holes 135. As was previously described, bolts 90 can be moved toward each other or away from each other so that the distance between their shafts corresponds to the spacing between holes 135. The shafts of bolts 90 are inserted through holes 135 and washers 137 and nuts 139 lock them in place. Thus, adapter plate 200 allows skid 2 to be secured to a wide variety of auger housings that may have bolt centers that differ from the spacing between holes 135 in the side wall 130*b* illustrated herein. If and when it is desired to remove skid 2 from auger housing 130, nuts 79 and 139 are removed and skid 2 and adapter plate 200 are pulled off side wall 130*b*.

Figure 20:
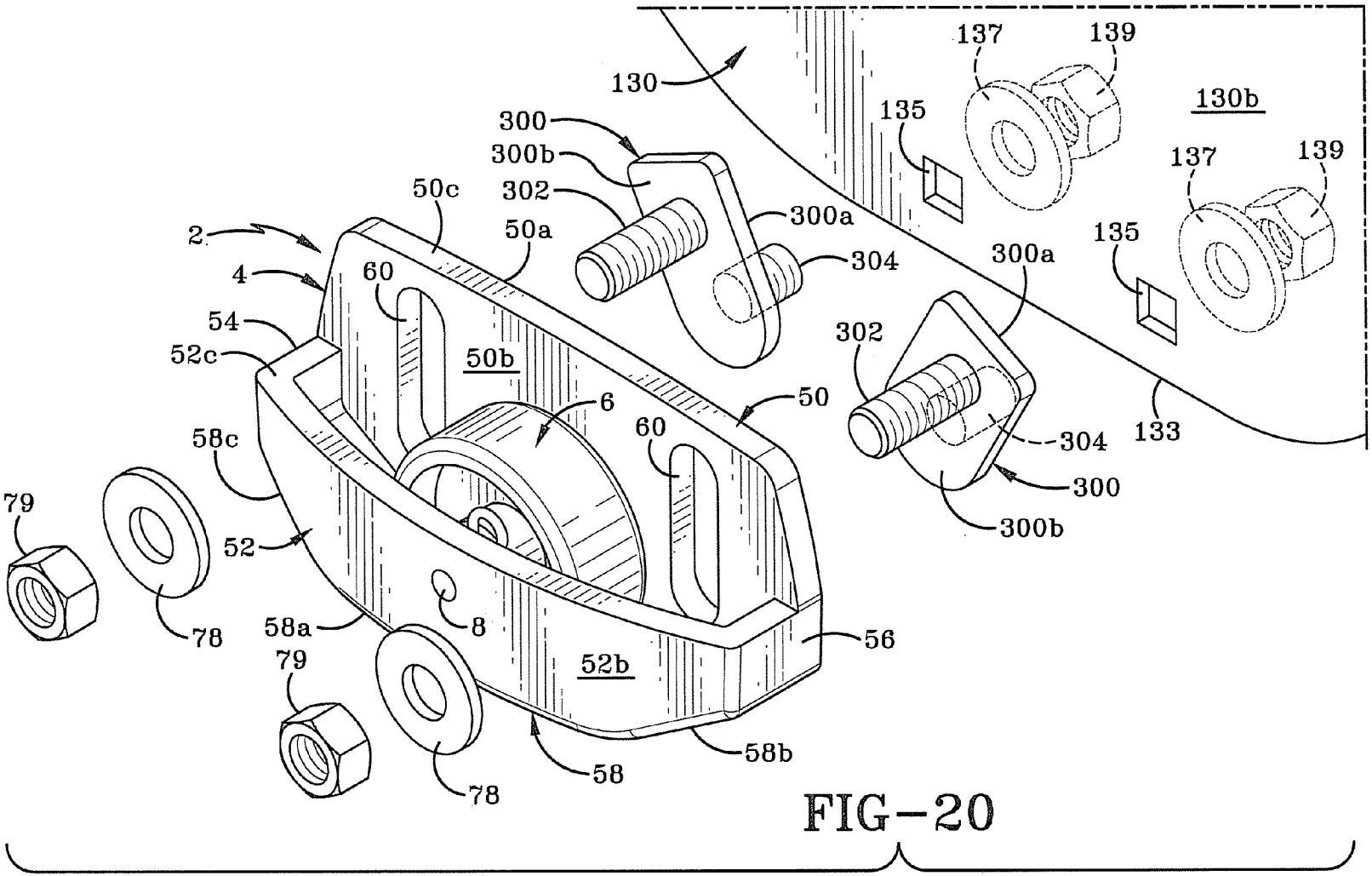
FIG. 20 is an exploded left side perspective view of an alternative manner for securing the skid to the side wall of an auger housing utilizing a third embodiment of an adapter plate.

FIG. 20 shows a third embodiment of an adapter plate in accordance with the present invention and is generally indicated at 300. Adapter plate 300 comprises a planar member that has a first surface 300*a* and a second surface 300*b*. A first threaded rod 302 extends outwardly from second surface 300*b* in a first direction and a second threaded rod 304 extends outwardly from first surface 300*a* in a second direction. First and second rods are vertically and horizontally offset relative to each other. This makes it possible for adapter plate 300 to be rotated to match the spacing between holes 135 and slots 60 on different snow blowers and skids 2. First rods 302 are received through the slots 60 and second rods 304 are received through holes 135. Adapter plates 300 are secured to first side wall 50 of skid by inserting first rod 302 through one of the slots 60 and then a washer 78 and nut 79 are engaged therewith so that adapter plate 300 is loosely engaged with skid. When both adapter plate 300 have been loosely secured to skid 2, then second rods 304 are inserted through holes 135 in side wall 130*b* of auger housing 130. If the holes 135 are close together, then the bottom ends of the two adapter plates 300 are rotated inwardly toward each other to permit second rods 304 to be inserted through holes 135. Once this has occurred, washers 137 are engaged on second rods 304 and nuts 139 are secured in place. If the holes 135 are further away from each other (which is not illustrated herein) then the bottom ends of the two adapter plates 300 are rotated outwardly away from each other so that the second rods 304 can be inserted through the differently spaced holes 135 and then the washers 137 and nuts 139 are engaged with second rods 304. The operator will then tightly secure nuts 79 and 139 in place on the first and second rods 302, 304 to lock skid 2, adapter plates 300 and side wall 130*b* together. Obviously, removing skid 2 from auger housing 130 is accomplished by simply removing nuts 79 and 139 and pulling the skid 2 and adapter plates 300 off side wall 139.

It will be understood that the body with the sliding surface and rolling surface may be formed as part of the side walls of an auger housing instead of being provided as a separate component that is secured to the side walls of the auger housing, without departing from the scope of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A skid for use on a snow blower, where the snow blower includes an auger housing through which snow removed from an area is channeled, said skid comprising:

a body adapted to be secured to a vertical side wall of the auger housing; said body including:

a first side wall adapted to abut the side wall of the auger housing;

a second side wall spaced from the first side wall;

a first end wall and a second end wall spaced from each other and extending between the first and second side walls; and wherein the body has a longitudinal axis that extends between the first and second end walls;

a sliding surface extending between a bottom end of the first side wall and a bottom end of the second side wall; said sliding surface being adapted to assist the auger housing to slide over snow-covered regions of the area to be cleared; and wherein each of the first and second side walls extends upwardly from the sliding surface and a top end of the first side wall is spaced a vertical distance beyond a top end of the second side wall; and a rolling surface adapted to assist the auger housing to travel over snow-free regions of the area to be cleared, and wherein at least a portion of the rolling surface extends for a distance below the sliding surface.

2. The skid as defined in claim 1, further comprising a slot defined in the sliding surface, and wherein the portion of the rolling surface extends through the slot.

3. The skid as defined in claim 2, wherein the sliding surface includes:

a central face disposed generally equidistant between the first and second end walls and parallel to the body's longitudinal axis; and wherein the central face has a substantially planar exterior surface; and a first face extending outwardly from a first end of the central face and to a bottom end of the first end wall; and wherein the slot is defined in the central face.

4. The skid as defined in claim 3, wherein the first face is disposed at a first angle to the exterior surface of the central face, and wherein the first angle is such that the first face angles upwardly away from the first end of the central face.

5. The skid as defined in claim 4, wherein the first angle is between 25 degrees and 35 degrees relative to the exterior surface of the central face.

6. The skid as defined in claim 5, wherein the first angle is 30 degrees relative to the exterior surface of the central face.

7. The skid as defined in claim 3, wherein the sliding surface further includes:

a second face extending between a second end of the central face and the second end wall of the body, and wherein the second face is disposed at a second angle to the exterior surface of the central face, and wherein the second angle is such that the second face angles upwardly away from the second end of the central face.

8. The skid as defined in claim 7, wherein the second angle is between 25 degrees and 35 degrees relative to the exterior surface of the central face.

9. The skid as defined in claim 8, wherein the second angle is 30 degrees relative to the exterior surface of the central face.

10. The skid as defined in claim 3, wherein the rolling surface comprises:

an axle extending between the first and second side walls and disposed substantially at right angles to the longitudinal axis of the body;

a wheel rotatably mounted on the axle; and a circumferential surface provided on the wheel and adapted to contact the area to be cleared of snow by the snow blower.

11. The skid as defined in claim 10, wherein a chamber is defined between the first side wall and the second side wall; and wherein the axle extends across the chamber and between the first and second side walls, and wherein the wheel is disposed at least partially within the chamber; and wherein the chamber has an opening defined between the top ends of the first and second side walls.

12. The skid as defined in claim 11, wherein the body further includes:

a securement mechanism adapted to secure the body to the side wall of the auger housing, and wherein the securement mechanism is accessible through the opening to the chamber.

13. The skid as defined in claim 12, wherein the securement mechanism comprises:

a slot defined in the first side wall of the body; and a fastener adapted to secure the first side wall of the body to the side wall of the auger housing, said fastener being received through the slot in the first side wall and being selectively movable therealong to permit the body to be adjustably positioned on the side wall of the auger housing.

14. The skid as defined in claim 12, further comprising:

an adapter plate having a first side surface and a second side surface, wherein said second side surface of the adapter plate is disposed in abutting contact with an exterior surface of the first side wall, and the first side surface of the adapter plate is adapted to be disposed in abutting contact with the side wall of the auger housing; and a first fastener extends between the first side wall of the body and the second side surface of the adapter plate; and a second fastener is adapted to extend between the first side surface of the adapter plate and the side wall of the auger housing.

15. The skid as defined in claim 14, wherein the positioning of one or both of the first and second fasteners on the adapter plate is adjustable so as to permit the body to be secured to a variety of different auger housings.

16. The skid as defined in claim 14, wherein the first and second fasteners are one or both of vertically and horizontally offset relative to each other on the adapter plate.

17. The skid as defined in claim 16, further comprising:

an additional first fastener that extends between the first side wall of the body and the second side surface of the adapter plate; and an additional second fastener that is adapted to extend between the first side surface of the adapter plate and the side wall of the auger housing; and wherein the first fastener and additional first fastener are longitudinally spaced apart from each other by a first distance, and the second fastener and additional second fastener are longitudinally spaced apart from the other by a second distance; and the first fastener and additional first fastener are generally horizontally aligned with each other, and the second fastener and additional second fastener are generally horizontally aligned with each other and are generally vertically spaced from the first fastener and additional first fastener by a third distance; and wherein one or more of the first, second and third distances are adjustable.

18. The skid as defined in claim 16, further comprising:

a second adapter plate having a first side surface and a second side surface;

an additional first fastener that extends between the first side wall of the body and the second side surface of the second adapter plate; and an additional second fastener that is adapted to extend between the first side surface of the second adapter plate and the side wall of the auger housing; and wherein the first fastener and additional first fastener are longitudinally spaced apart from each other by a first distance, and the second fastener and additional second fastener are longitudinally spaced apart from the other by a second distance; and the first fastener and additional first fastener are generally horizontally aligned with each other, and the second fastener and additional second fastener are generally horizontally aligned with each other and are generally vertically spaced from the first fastener and additional first fastener by a third distance; and wherein one or more of the first, second and third distances are adjustable.

19. The skid as defined in claim 1 wherein the first side wall of the body is substantially planar in a longitudinal direction, and wherein the second side wall of the body is substantially curved in a longitudinal direction.

20. A snow blower comprising:

a frame;

a motor mounted on the frame;

an auger housing mounted on the frame; said auger housing having a pair of spaced apart vertical sidewalls;

an auger rotatably mounted between the pair of spaced apart vertical sidewalls of the auger housing;

an impeller mounted on the frame and disposed to receive snow cleared from a surface by the auger, said impeller being driven by the motor;

a chute operationally connected to the impeller; said chute being provided to direct removed snow received via the impeller to a location remote from the snow blower;

a pair of skids, each skid being adjustably secured to one of the pair of sidewalls of the auger housing; and wherein each skid comprises:

a body including:

a first side wall which abuts the respective one of the auger housing sidewalls;

a second side wall spaced from the first side wall;

a first end wall and a second end wall spaced from each other and extending between the first and second side walls; and wherein the body has a longitudinal axis that extends between the first and second end walls thereof;

a sliding surface extending between a bottom end of the first side wall and a bottom end of the second side wall; said sliding surface being adapted to assist the auger housing to slide over snow-covered regions of the area to be cleared; and wherein each of the first and second side walls extends upwardly from the sliding surface and a top end of the first side wall is spaced a vertical distance beyond a top end of the second side wall; and a rolling surface, and wherein at least a portion of said rolling surface projects for a distance downwardly beyond the sliding surface.

21. The skid as defined in claim 19, wherein the second side wall is substantially convex in relationship to the first side wall.

22. The skid as defined in claim 10, further comprising:

a through-hole defined in the axle; and a cotter pin is received through the through-hole to prevent withdrawal of the axle from its engagement with first and second side walls.

* * * * *